US007094134B2

(12) United States Patent
Lujan

(10) Patent No.: US 7,094,134 B2
(45) Date of Patent: Aug. 22, 2006

(54) OFF-LINE TOOL FOR BREAKING IN MULTIPLE PAD CONDITIONING DISKS USED IN A CHEMICAL MECHANICAL POLISHING SYSTEM

(75) Inventor: Randall J. Lujan, Round Rock, TX (US)

(73) Assignees: Samsung Austin Semiconductor, L.P., Austin, TX (US); Samsung Electronics Co., Ltd., Suwon-Si (KR)

( * ) Notice: Subject to any disclaimer, the term of this patent is extended or adjusted under 35 U.S.C. 154(b) by 135 days.

(21) Appl. No.: 10/873,558

(22) Filed: Jun. 22, 2004

(65) Prior Publication Data

US 2005/0282476 A1 Dec. 22, 2005

(51) Int. Cl.
*B24B 1/00* (2006.01)

(52) U.S. Cl. ..... 451/56; 451/41; 451/443

(58) Field of Classification Search ..... 451/56, 451/41, 63, 285, 287, 443
See application file for complete search history.

(56) References Cited

U.S. PATENT DOCUMENTS

| | | | | |
|---|---|---|---|---|
| 6,093,088 | A * | 7/2000 | Mitsuhashi et al. | 451/285 |
| 6,695,680 | B1 * | 2/2004 | Choi et al. | 451/5 |
| 6,695,684 | B1 * | 2/2004 | Park et al. | 451/56 |
| 6,769,972 | B1 * | 8/2004 | Huang et al. | 451/287 |
| 6,783,445 | B1 * | 8/2004 | Torii et al. | 451/287 |
| 6,796,885 | B1 * | 9/2004 | Vanell | 451/72 |
| 6,806,193 | B1 * | 10/2004 | Korthuis et al. | 438/692 |
| 6,837,773 | B1 * | 1/2005 | Brunelli | 451/7 |
| 6,840,840 | B1 * | 1/2005 | Moore | 451/5 |

* cited by examiner

*Primary Examiner*—Eileen P. Morgan

(57) ABSTRACT

An off-line tool for breaking in pad conditioning disks used in a chemical mechanical polishing (CMP) system. The off-line tool comprises a platen having a first surface for holding a polishing pad and a motor for rotating the polishing pad. The motor is coupled to the platen via a first drive shaft. The off-line tool further comprises a mechanical drive assembly for holding a second drive shaft in a position proximate the first surface of the platen and a first break-in head removably attached to the second drive shaft. The first break-in head receives a first pad conditioning disk and the second drive shaft moves the first break-in head toward the platen, thereby pressing the first pad conditioning disk against the polishing pad on the platen.

23 Claims, 6 Drawing Sheets

OFF-LINE TOOL FOR BREAKING IN MULTIPLE PAD CONDITIONING DISKS USED IN A CHEMICAL MECHANICAL POLISHING SYSTEM

CROSS-REFERENCE TO RELATED APPLICATION

The present invention is related to that disclosed in U.S. patent application Ser. No. 10/873,557, entitled "APPARATUS AND METHOD FOR BREAKING IN MULTIPLE PAD CONDITIONING DISKS FOR USE IN A CHEMICAL MECHANICAL POLISHING SYSTEM," filed concurrently herewith. The subject matter disclosed in patent application Ser. No. 10/873,557 is hereby incorporated by reference into the present disclosure as if fully set forth herein.

TECHNICAL FIELD OF THE INVENTION

The present invention is directed to chemical mechanical polishing (CMP) systems and, more specifically, to an off-line tool that breaks in multiple pad conditioning disks without halting operation of a CMP system.

BACKGROUND OF THE INVENTION

Chemical mechanical polishing (CMP), also called chemical mechanical planarization, is a well-known process for removing oxide and other deposits from the surface of a wafer. CMP systems are frequently used during the processing of silicon semiconductor wafers. CMP systems are made by a number of vendors, including Applied Materials, Inc., of Santa Clara, Calif. Many conventional CMP systems polish semiconductor wafers by abrading the surface of the wafer with a silica-based slurry.

FIG. 1 illustrates selected portions of chemical mechanical polishing (CMP) system 100 according to an exemplary embodiment of the prior art. CMP system 100 comprises support platform 101, platen 105, polishing pad 110, pad conditioning disk 115, spindle 120, disk actuator 125, motor 130, and drive shaft 135. CMP system 100 further comprises motor 140, drive shaft 145, polishing head 150, motor 160, drive shaft 165, and slurry dispenser 170. Applied Materials (AMAT) manufactures the AMAT Mirra™ CMP system, which houses three CMP systems similar to CMP system 100 in an enclosure. It is noted that the components of CMP system 100 depicted in FIG. 1 are not drawn to scale. Rather, the sizes and relative positions of the components of CMP system 100 are selected for easy reference and explanation.

The operation of CMP system 100 is widely understood. Drive motor 140 and drive shaft 145 rotate platen 105 and polishing pad 110. Slurry dispenser 170 dispenses onto polishing pad 110 a silica-based slurry made from deionized water mixed with $SiO_2$ (or KOH). Rotation of pad 110 carries the slurry underneath polishing head 150. A silicon wafer (not shown) is attached to the bottom surface of polishing head 150, which may be, for example, a Titan™ polishing head from Advanced Material, Inc. The wafer may be held in place on the bottom surface of polishing head 150 by vacuum pressure created by a membrane.

Motor 160 and drive shaft 165 rotate polishing head 150 and the attached wafer and press polishing head 150 and attached wafer downward onto polishing pad 110. This downward pressure forces the exposed surface of the attached silicon wafer into firm contact with the moving slurry dispensed on rotating polishing pad 110. The movement and pressure of the slurry abrades the exposed surface of the silicon wafer. The abrasion removes silicon oxide or other materials that are deposited on the exposed surface of the silicon wafer attached to the bottom of polishing head 150.

The efficient operation of CMP system 100 requires that the surface of polishing pad 110 be continually conditioned by pad conditioning disk 115. Polishing pad 110 may be made of polyurethane, for example. The surface of polishing pad 110 is covered by tiny grooves (e.g., depth=0.03 inch) that capture slurry particles. Pad conditioning maintains an acceptable oxide removal rate and stable performance. Pad conditioning helps maintain optimal pad roughness and porosity, thereby ensuring the even transport of slurry to the wafer surface. Without conditioning by pad conditioning disk 115, the surface of polishing pad 110 glazes and oxide removal rates decline.

The bottom surface of disk 115 is coated by an abrasive layer, such as a layer of nickel in which fine diamonds are embedded. Diamond pad conditioning disks are the most widely used method of pad conditioning in wafer fabrication facilities today. Pad conditioning disk 115 refreshes (or wears) the surface of polishing pad 110 during CMP processing to thereby maintain a uniform surface on polishing pad 110.

Disk actuator 125, motor 130 and drive shaft 135 drive pad conditioning disk 115, which is rigidly attached to spindle 120. Disk actuator 125 and drive shaft 135 contain the necessary gearing and other drive mechanisms to rotate spindle 120, thereby rotating disk 115. Disk actuator 125 and drive shaft 135 also contain the necessary drive mechanisms to sweep rotating disk 115 back and forth across the surface of rotating polishing pad 110.

The performance of pad conditioning disk 115 has a significant impact on the cost of operating CMP system 100. Aggressive use of pad conditioning disk 115 gives good process performance, but rapidly wears out polishing pad 110, thereby reducing pad life and increasing cost. A less aggressive use of pad conditioning disk 115 may not provide enough conditioning to polishing pad 110, resulting in unstable process performance.

Disk flatness is an important aspect of pad conditioning disk 115, since even wear across polishing pad 110 increases pad life and process stability. To ensure disk flatness, a new pad conditioning disk 115 must be broken in prior to use in an actual on-line CMP process. The process of breaking in a new disk 115 typically involves taking CMP system 100 off line, removing the wafer and polishing head 150, and attaching new disk 115 to spindle 120. Next, new disk 115 scours the surface of pad 110 for approximately 30 minutes, until the bottom surface of new disk 115 is itself evenly worn.

At this point, broken-in disk 115 is removed, pad 110 is replaced with a new pad, polishing head 150 is re-attached, and CMP system 100 is re-qualified. The process of re-qualifying CMP system 100 may require another two hours. The AMAT Mirra™ CMP system, which houses three CMP systems similar to CMP system 100 in a single enclosure, may break in three pad conditioning disks 115 at a time. Nonetheless, the process of breaking-in pad conditioning disk 115 may take CMP system 100 off line for two and a half hours.

It is important to improve process performance by increasing productivity and reducing cost of ownership. However, taking CMP system 100 off line to break in new disks 115 makes achieving these goals more difficult. Reducing off-line time has the added benefit of minimizing the frequency of tool re-qualification, resulting in higher availability and more finished wafers per month.

Therefore, there is a need in the art for an improved chemical mechanical polishing (CMP) system that has reduced off line time. In particular, there is a need for an improved system and method for breaking in pad conditioning disks that reduce the amount of time that a chemical mechanical polishing (CMP) system must be taken off line.

SUMMARY OF THE INVENTION

Co-pending patent application Ser. No. 10/873,557 introduced a novel multiple disk break-in head that may be used in a conventional chemical mechanical polishing (CMP) system to increase the number of pad conditioning disks that may be broken in whenever a CMP system is taken off line. The multiple disk break-in head disclosed in co-pending patent application Ser. No. 10/873,557 replaces the removed polishing head of a CMP system whenever new disks are broken in on the CMP system.

The present invention improves upon co-pending patent application Ser. No. 10/873,557 by introducing an off-line break-in tool that uses the multiple disk break-in head to break in new pad conditioning disks without taking the CMP system off line. The off-line break-in tool comprises a platen and polishing pad similar to a CMP system and a motor for rotating the platen and polishing pad. The off-line break-in tool also comprises an assembly that presses one or more multiple disk break-in heads downward onto the rotating polishing pad. Slurry is poured onto the rotating polishing pad by a slurry dispenser.

To address the above-discussed deficiencies of the prior art, it is a primary object of the present invention to provide an off-line tool for breaking in pad conditioning disks used in a chemical mechanical polishing (CMP) system. According to an advantageous embodiment of the present invention, the off-line tool comprises: 1) a platen having a first surface for mounting a polishing pad thereon; 2) a motor for rotating the polishing pad, wherein the motor is coupled to the platen via a first drive shaft; 3) a mechanical drive assembly capable of holding a second drive shaft in a position proximate the first surface of the platen; and 4) a first break-in head capable of being removably attached to the second drive shaft. The first break-in head is adapted to receive a first pad conditioning disk and the second drive shaft is operable to move the first break-in head toward the platen, thereby pressing the first pad conditioning disk against the polishing pad mounted on the first surface of the platen.

According to one embodiment of the present invention, the mechanical drive assembly is capable of holding a third drive shaft in a position proximate the first surface of the platen.

According to another embodiment of the present invention, the off-line break in tool further comprises a second break-in head capable of being removably attached to the third drive shaft, wherein the second break-in head is adapted to receive a second pad conditioning disk, and wherein the third drive shaft is operable to move the second break-in head toward the platen, thereby pressing the second pad conditioning disk against the polishing pad.

According to still another embodiment of the present invention, the mechanical drive assembly is capable of rotating the second and third drive shafts.

According to yet another embodiment of the present invention, the mechanical drive assembly couples the first drive shaft to the second and third drive shafts such that rotation of the first drive shaft causes rotation of the second and third drive shafts.

According to a further embodiment of the present invention, the first break-in head comprises a first drive mechanism capable of rotating the first pad conditioning disk.

According to a still further embodiment of the present invention, the first drive mechanism is coupled to the second drive shaft and rotates the first pad conditioning disk by translating a rotating motion of the second drive shaft into a rotating motion of the first pad conditioning disk.

According to a yet further embodiment of the present invention, the first drive mechanism comprises a first gear assembly coupled to the second drive shaft and to a first spindle connected to the first pad conditioning disk.

Before undertaking the DETAILED DESCRIPTION OF THE INVENTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present invention and its advantages, reference is now made to the following description taken in conjunction with the accompanying drawings, in which like reference numerals represent like parts.

DETAILED DESCRIPTION OF THE INVENTION

FIGS. 2 through 6, discussed below, and the various embodiments used to describe the principles of the present invention in this patent document are by way of illustration only and should not be construed in any way to limit the scope of the invention. Those skilled in the art will understand that the principles of the present invention may be implemented in any suitably arranged chemical mechanical polishing (CMP) system.

Figure 1:
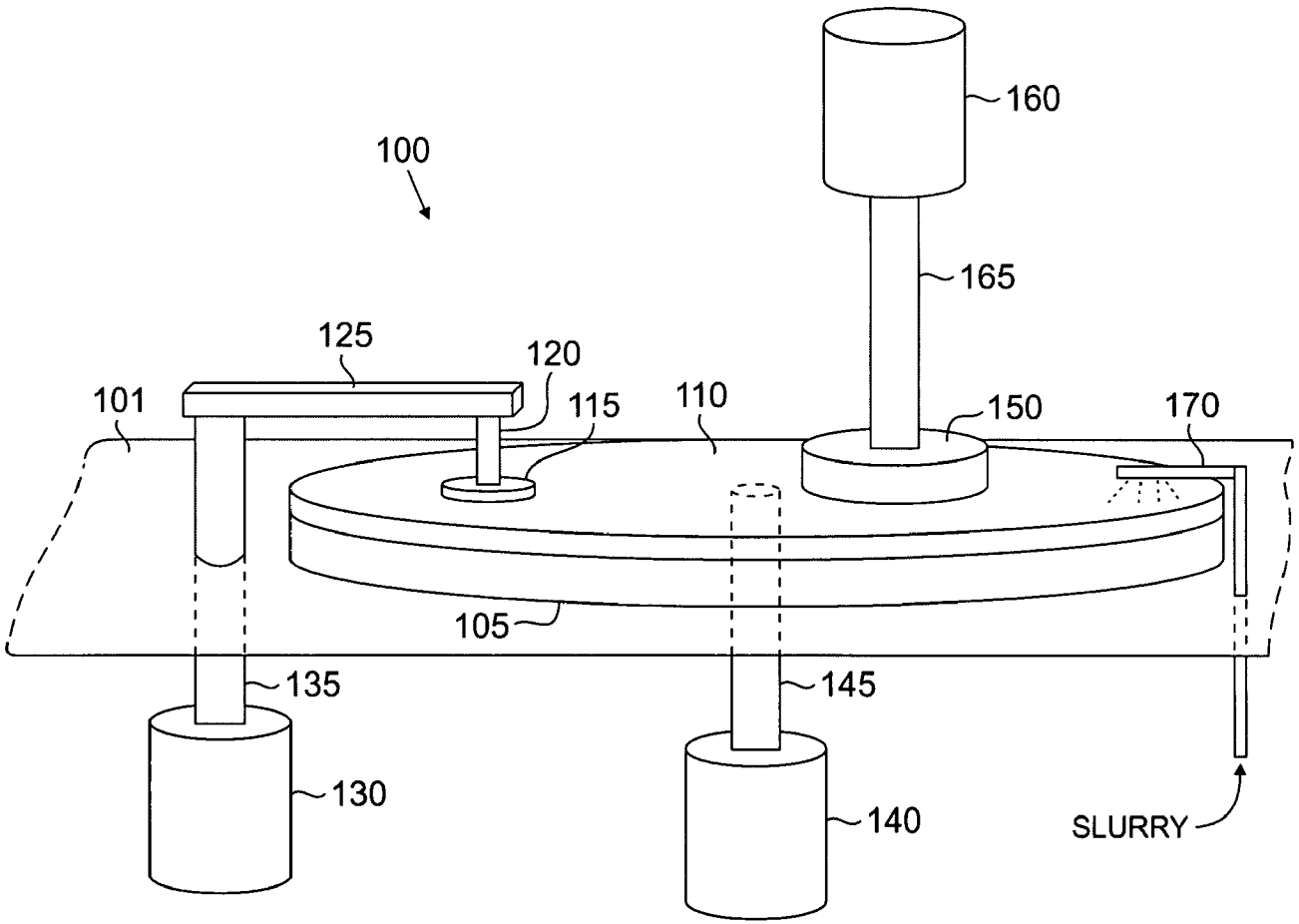
FIG. 1 (PRIOR ART)
FIG. 1 illustrates selected portions of a chemical mechanical polishing (CMP) system according to an exemplary embodiment of the prior art.
Figure 2:
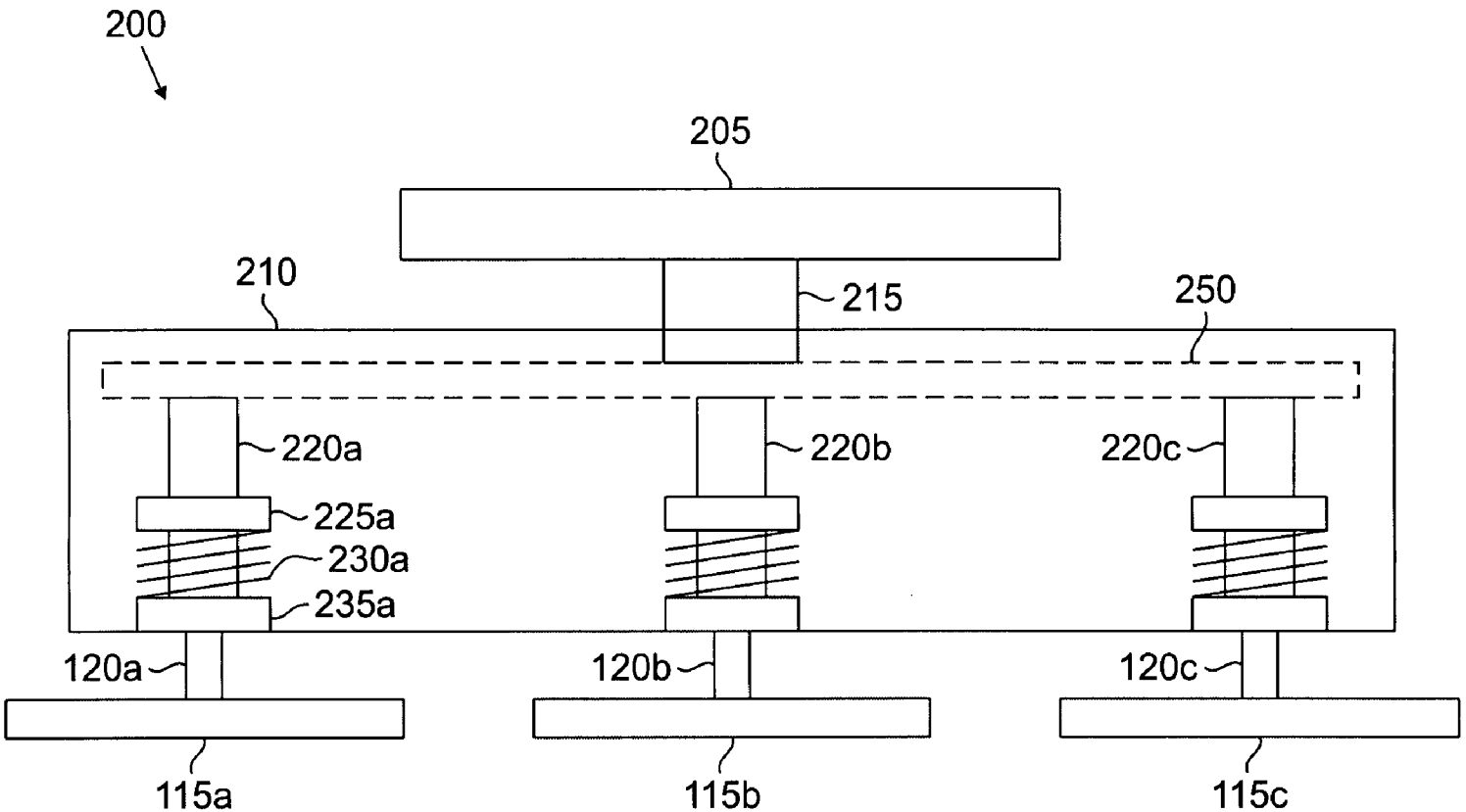
FIG. 2 illustrates a side view of selected portions of a multiple disk break-in head.

FIG. 2 illustrates a side view of selected portions of multiple disk break-in head 200 according to an exemplary embodiment of the present invention. When CMP system 100 is taken off line, polishing head 150 is removed and break-in head 200 is installed in CMP system 100 in place of polishing head 150. The exemplary embodiment of break-in head 200 holds four pad conditioning disks 115, namely disk 115*a*, disk 115*b*, disk 115*c* and disk 115*d* (not visible in FIG. 1). In alternate embodiments of the present invention, break-in head 200 may hold more than four disks 115 or less than four disks 115.

Multiple disk break-in head 200 comprises coupling 205, circular housing 210, drive shaft 215, and drive mechanism 250 (shown by dotted outline). Coupling 205 is used to attach break-in head to drive shaft 165 in CMP system 100. Drive shaft 215 transfers the rotation of drive shaft 165 to drive mechanism 250.

Break-in head 200 further comprises four spindles 120, namely spindle 120*a*, spindle 120*b*, spindle 120*c* and spindle 120*d* (not visible in FIG. 2). Disk 115*a* is removably coupled to spindle 120*a*, disk 115*b* is removably coupled to spindle 120*b*, disk 115*c* is removably coupled to spindle 120*c*, and disk 115*d* is removably coupled to spindle 120*d*.

Break-in head 200 also comprises four drive shafts 220, including drive shaft 220*a*, drive shaft 220*b*, drive shaft 220*c*, and drive shaft 220*d* (not visible in FIG. 2). Spindles 120 are coupled to drive shafts 220 by retaining rings 225, springs 230, and retaining rings 235. For example, retaining ring 235*a* is rigidly attached to spindle 120*a* and to drive shaft 220*a*. Retaining ring 225*a* is rigidly attached to the body of housing 210 and is slidably coupled to drive shaft 220. Drive shaft 220 is slidably attached to a drive gear in drive mechanism 250.

When break-in head 200 is pressed down on pad 110, spindle 120*a* and retaining ring 235*a* press upward on spring 230*a*. Drive shaft 220*a* also is pressed upward by retaining ring 230*a*. The upward movement of drive shaft 220*a* is accommodated by the slidable coupling to the gears in drive mechanism 250. Retaining ring 225*a* is rigidly attached to housing 210 and resists the upward movement of spring 230*a*. Thus, the pressure of disk 115*a* against the surface of pad 110 is determined by the characteristics of spring 230*a*.

Disks 115*b*, 115*c* and 115*d* are connected to drive shafts 220*b*, 220*c* and 220*d* by similar assemblies of retaining rings, spindles, and springs. The operation of these other assemblies are similar to the operation of ring 225*a*, ring 235*a*, and spring 230*a* and need not be explained separately. To avoid redundancy, such separate explanations are omitted.

Figure 3:
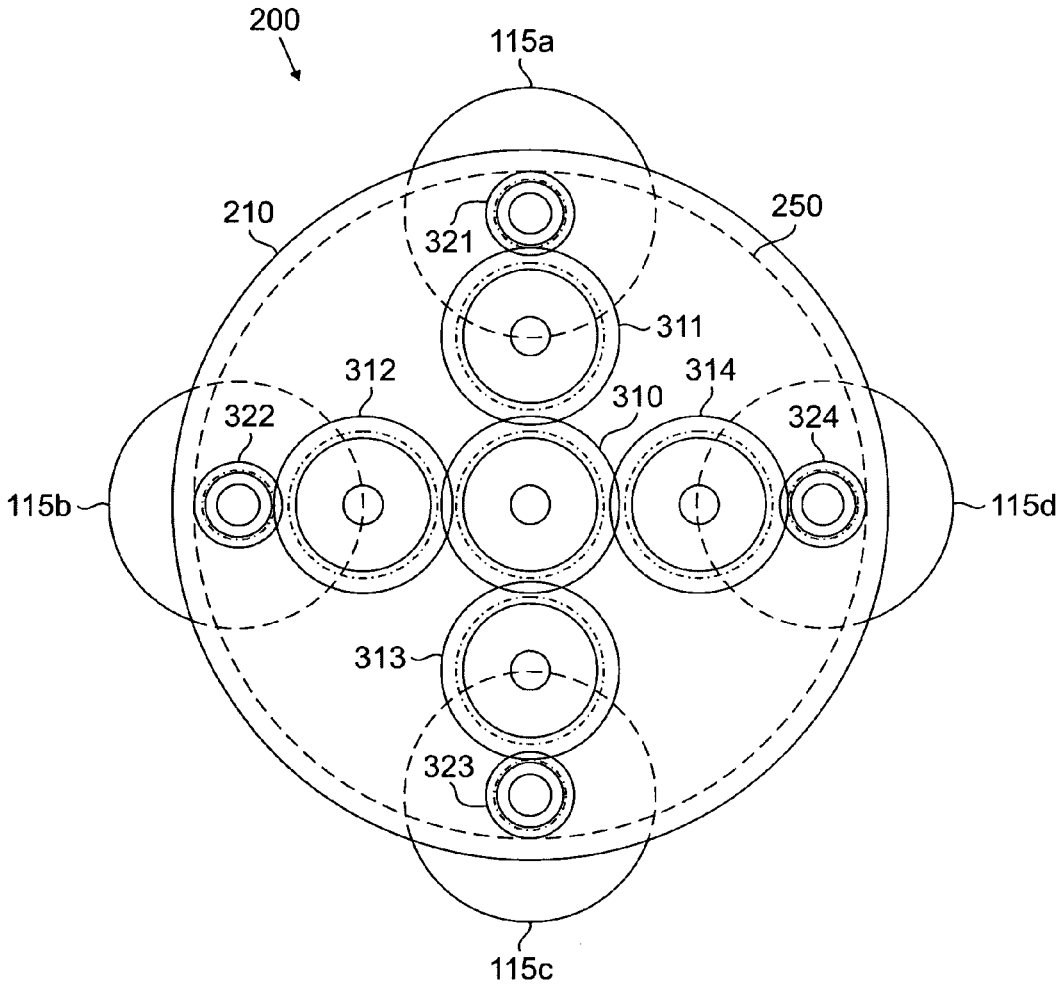
FIG. 3 illustrates a top view of selected portions of a multiple disk break-in head.

FIG. 3 illustrates a top view of selected portions of multiple disk break-in head 200 according to an exemplary embodiment of the present invention. Exemplary drive mechanism 250 is enclosed by a dotted line. Exemplary drive mechanism 250 comprises central gear 310, transfer gears 311–314 and drive gears 321–324. Disks 115*a*–115*d* are positioned below break-in head 200 and are shown in partial dotted outlines.

Central gear 310 is coupled to, and rotated by, drive shaft 215. Transfer gear 311 transfers the rotation of central gear 310 to drive gear 321, which in turn causes the rotation of disk 115*a*. Transfer gear 312 transfers the rotation of central gear 310 to drive gear 322, which in turn causes the rotation of disk 115*b*. Transfer gear 313 transfers the rotation of central gear 310 to drive gear 323, which in turn causes the rotation of disk 115*c*. Transfer gear 314 transfers the rotation of central gear 310 to drive gear 324, which in turn causes the rotation of disk 115*d*.

In this manner, the rotation of drive shaft 165 in CMP system 100 causes the individual rotations of each of disks 115*a*, 115*b*, 115*c* and 115*d*. The relative sizes of central gear 310, transfer gears 311–314, and drive gears 321–324 determine the speed of rotation of disks 115*a*–115*d*.

The exemplary arrangement of the gears in drive mechanism 250 is by way of example only and should not be construed to limit the scope of the present invention. Those skilled in the art will readily understand that many other types of mechanical drive systems may be used to rotate pad conditioning disks 115*a*–115*d*. For example, in an alternate embodiment, a single large central gear 310 may directly couple to drive gears 321–324 without the use of intermediate transfer gears. In still other embodiments, belts or chains may be used to rotate disks 115*a*–115*d*.

Figure 4:
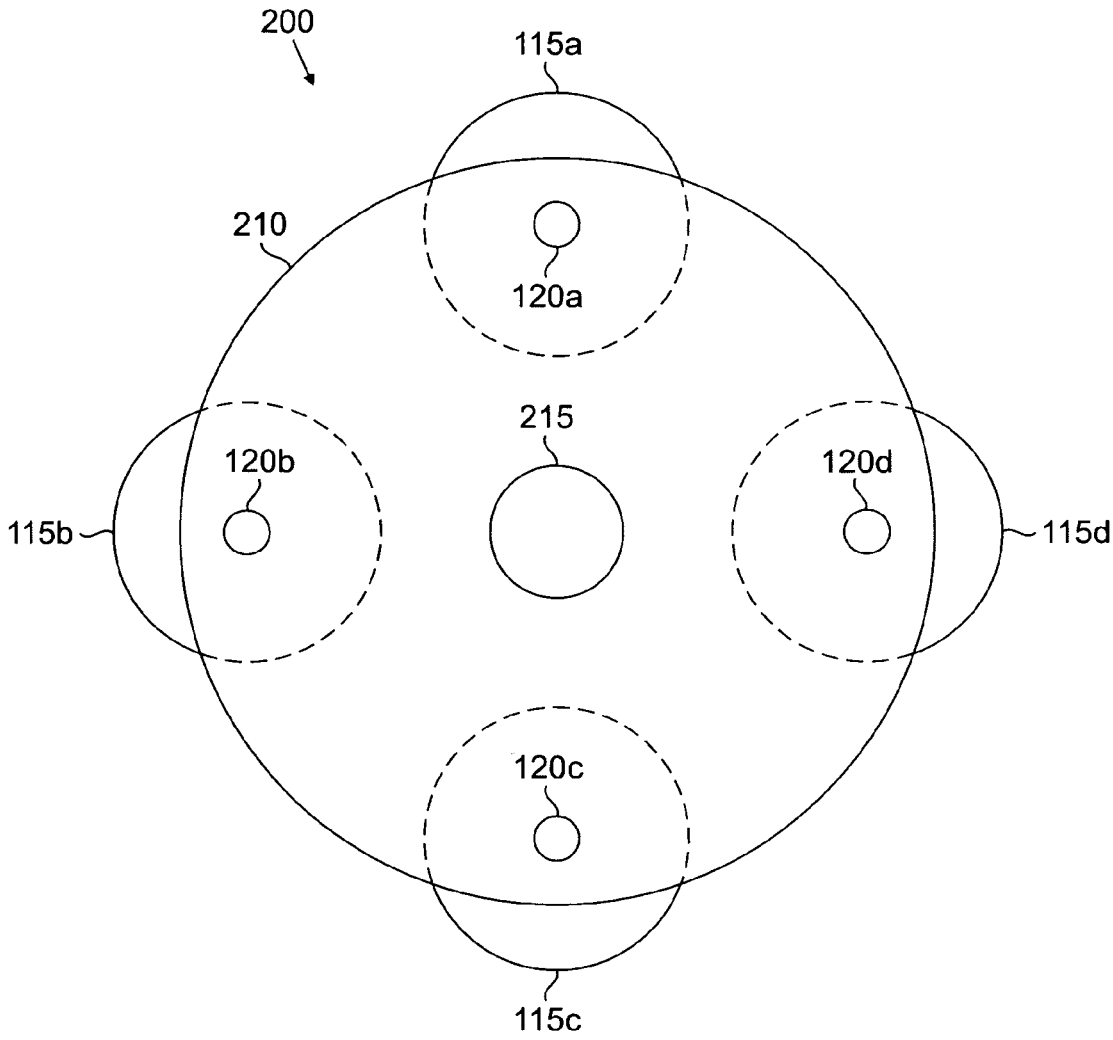
FIG. 4 illustrates a top view of selected portions of a multiple disk break-in head according to an alternate embodiment.

FIG. 4 illustrates a top view of selected portions of multiple disk break-in head 200 according to an alternate exemplary embodiment of the present invention. In FIG. 4, drive mechanism 250 has been removed entirely, so that disks 115*a*–115*d* are not driven by drive shafts 165 and 215. Nonetheless, pad conditioning disks 115*a*–115*d* rotate when pressed down upon pad 110 due to the speed differences between different points on the surface of pad 110. Surface points near the outer diameter of pad 110 must move at a faster speed than surface points near the center of rotation of pad 110 in order to complete one rotation in the same time period. Thus, a first point on the bottom surface of disk 115 that is closer to the center of pad 110 contacts a slower moving portion of the surface of pad 110 than a second point on the bottom surface of disk 115 that is further from the center of pad 110. Thus, there is a greater amount of friction at the second point.

Spindle 120 is at the center of rotation of disk 115. Collectively, the combined friction of all of the points on the bottom surface of disk 115 that are located to the side of spindle 120 closer to the center of pad 110 is less than the combined friction of all of the points on the bottom surface of disk 115 that are located to the side of spindle 120 that is further from the center of pad 110. The friction difference causes disk 115 to rotate about spindle 120, even in the absence of drive mechanism 250.

The multiple disk break-in head described above overcomes the shortcomings of conventional chemical mechanical polishing (CMP) systems by greatly increasing the number of pad conditioning disks that may be broken in whenever a CMP system is taken off line. Instead of mounting only one new disk 115 on spindle 120 in FIG. 1, multiple (e.g., 4) other new disks 115 are mounted on other spindles 120 on break-in head 200 (which replaced polishing head 150) and are broken-in at the same time.

However, the process of breaking-in new pad conditioning disks may be further improved by means of an off-line tool that completely eliminates the need to halt CMP system 100 in order to break in new disks. The new off-line tool uses one or more of the multiple disk break-in heads 200 described above to break in pad conditioning disks while CMP system continues to polish semiconductor wafers.

Figure 5:
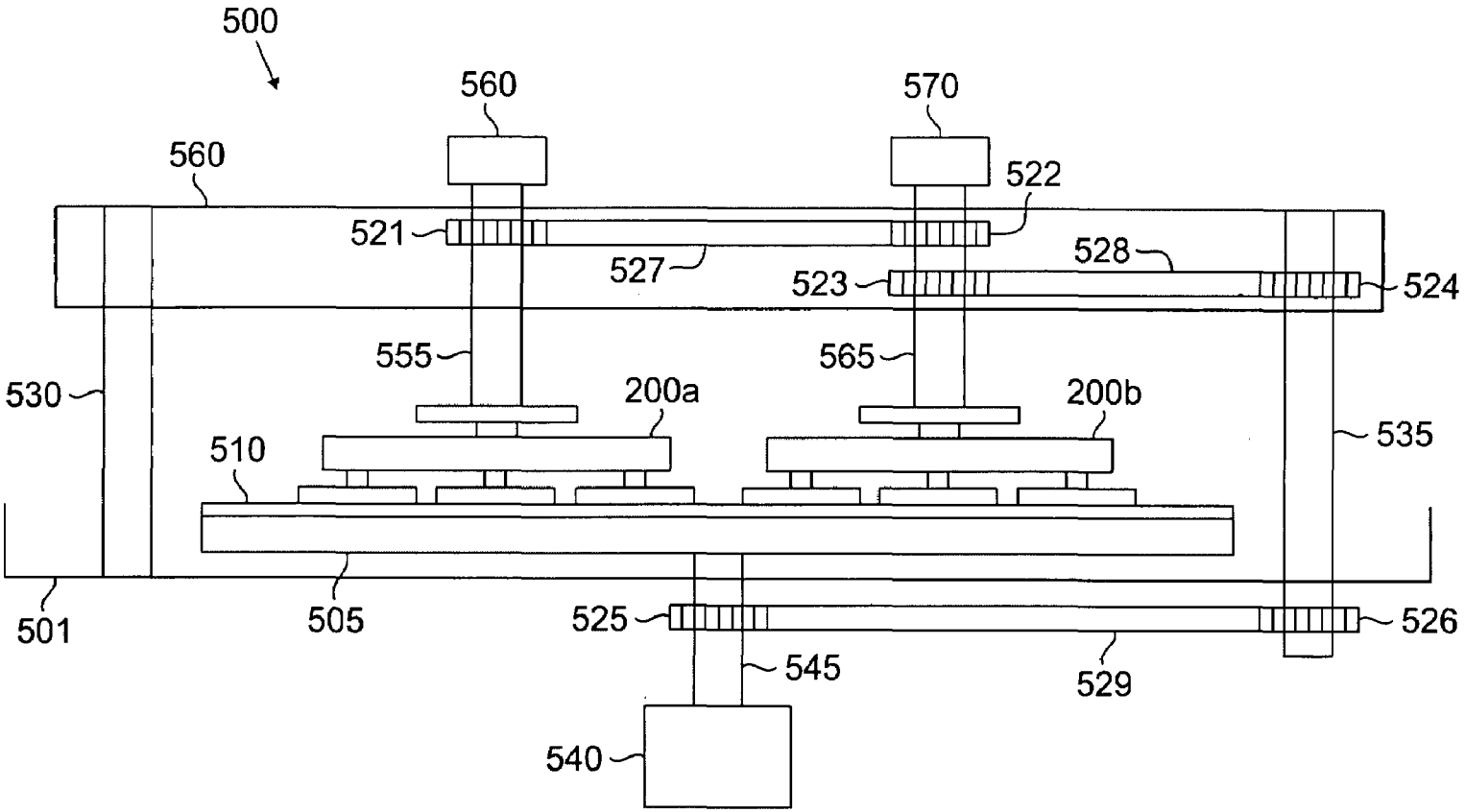
FIG. 5 illustrates a side view of selected portions of an off-line break-in tool that uses a multiple disk break-in head according to an exemplary embodiment of the present invention.

FIG. 5 illustrates a side view of selected portions of off-line break-in tool 500, which uses multiple disk break-in heads 200*a* and 200*b*, according to an exemplary embodiment of the present invention. Off-line break-in tool 500 comprises basin 501, platen 505, polishing pad 510, head drive assembly 520, support 530, drive shaft 535, motor 540, drive shaft 545, drive shaft 555 and drive shaft 565. Off-line break-in tool 500 further comprises gears 521 526, drive chains (or belts) 527–529, weight 560, weight 570, and a slurry dispenser 610 (not visible in FIG. 5). It is noted that the components of break-in tool 500 depicted in FIG. 5 are not drawn to scale. The sizes and relative positions of the components of break-in tool 500 are selected for easy reference and explanation.

Basin 501 catches excess slurry that overflows polishing pad 510 and provides a support platform for the other components of break-in tool 500. Support 530 and drive shaft 535 support head drive assembly 520 in position above platen 505. Motor 540 rotates drive shaft 545, which in turn rotates platen 505 and gear 525. Drive chain (or belt) 520 transfers the rotation of gear 525 to gear 526, which is attached to drive shaft 535. The rotation of gear 526 rotates drive shaft 535, which in turn rotates gear 524.

Drive chain (or belt) 528 transfers the rotation of gear 524 to gear 523, which is attached to drive shaft 565. The rotation of gear 523 rotates drive shaft 565, which in turn rotates gear 522. Drive chain (or belt) 527 transfers the rotation of gear 522 to gear 521, which is attached to drive shaft 555. The rotation of gear 521 rotates drive shaft 555. Thus, the rotation of motor 540 rotates all of drive shafts 535, 545, 555 and 565 via gears 521–526 and drive chains 527–529.

Moreover, the rotation of drive shaft 555 rotates the pad conditioning disks on the bottom surface of multiple disk break-in head 200*a* in the manner described above in FIGS. 2 and 3. Similarly, the rotation of drive shaft 565 rotates the pad conditioning disks on the bottom surface of multiple disk break-in head 200*b* in the manner described above in FIGS. 2 and 3. Thus, motor 540 powers the operation of all parts of off-line break-in tool 500.

Drive shaft 555 is slidably attached to gear 521, so that drive shaft 555 may slide vertically within gear 521. A spring or a similar mechanism (not shown) pushes upward on drive shaft 555, so that when multiple disk break-in head 200*a* is attached to drive shaft 555, multiple disk break-in head 200*a* is held in a raised (or UP) position in which the pad conditioning disks of multiple disk break-in head 200*a* do not touch polishing pad 510. However, when weight 560 is attached to drive shaft 555, drive shaft 555 slides downward and multiple disk break-in head 200*a* is pressed downward to a lowered (or DOWN) position in which the pad conditioning disks of break-in head 200*a* do make contact with polishing pad 510.

Similarly, drive shaft 565 is slidably attached to gears 522 and 523, so that drive shaft 565 may slide vertically within gears 522 and 523. A spring or a similar mechanism (not shown) pushes upward on drive shaft 565, so that when multiple disk break-in head 200*b* is attached to drive shaft 565, multiple disk break-in head 200*b* is held in a raised (or UP) position in which the pad conditioning disks of multiple disk break-in head 200*b* do not touch polishing pad 510. However, when weight 570 is attached to drive shaft 565, drive shaft 565 slides downward and multiple disk break-in head 200*b* is pressed downward to a lowered (or DOWN) position in which the pad conditioning disks of break-in head 200*b* do make contact with polishing pad 510.

Figure 6:
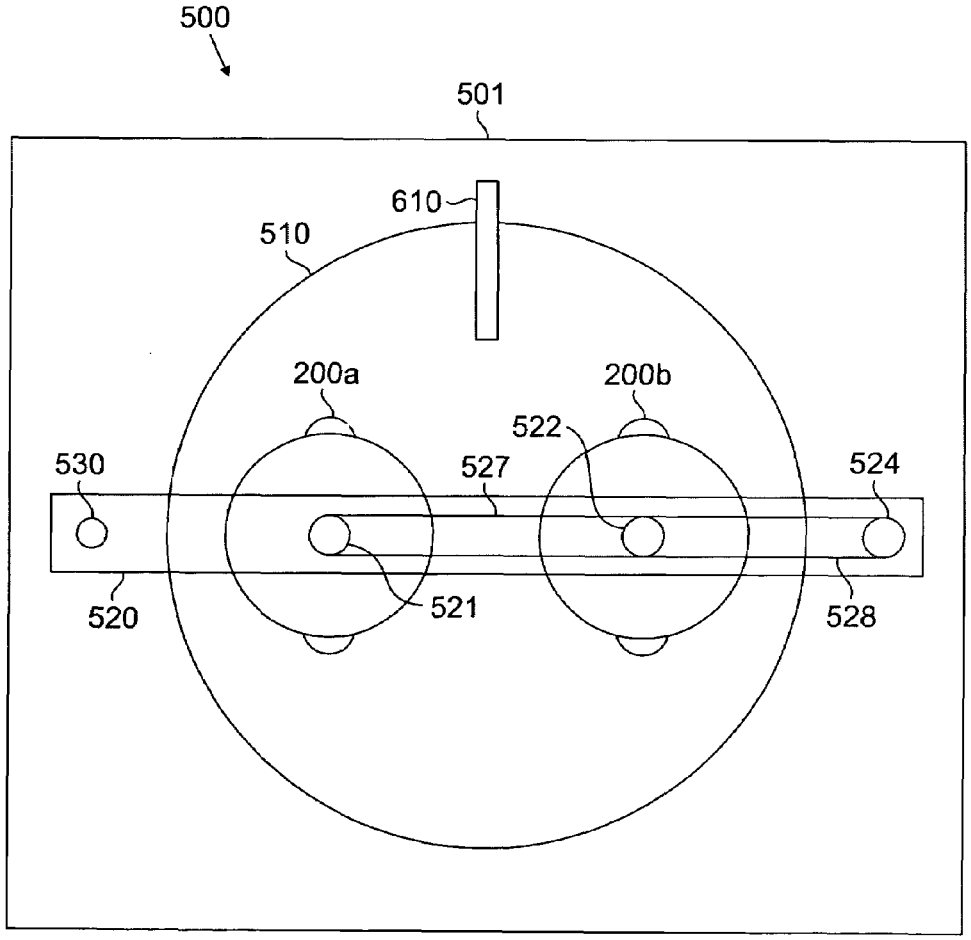
FIG. 6 illustrates a top view of selected portions of an off-line break-in tool that uses a multiple disk break-in head according to an exemplary embodiment of the present invention.

FIG. 6 illustrates a top view of selected portions of off-line break-in tool 500 according to an exemplary embodiment of the present invention. In FIG. 6, slurry dispenser 610 is visible, but weights 560 and 570 are not visible. Support 530, gear 521, gear 522, gear 524, and belts 527 and 528 are visible within head drive assembly 520.

Advantageously, the off-line break-in tool according to the principles of the present invention may also be used to break in, or condition, polishing head 150 prior to being used to polish semiconductor wafers. The lower surfaces of many conventional polishing heads, such as Titan™ polishing heads, must be smoothed prior to use to remove irregularities.

Although the present invention has been described with an exemplary embodiment, various changes and modifications may be suggested to one skilled in the art. It is intended that the present invention encompass such changes and modifications as fall within the scope of the appended claims.

What is claimed is:

1. An off-line tool for breaking in pad conditioning disks used in a chemical mechanical polishing (CMP) system, said off-line tool comprising:

a platen having a first surface for mounting a polishing pad thereon;

a motor for rotating said polishing pad, wherein said motor is coupled to said platen via a first drive shaft associated with a mechanical drive assembly;

said mechanical drive assembly capable of holding a second drive shaft in a position proximate said first surface of said platen; and a first break-in head capable of being removably attached to said second drive shaft, wherein said first break-in head is adapted to receive a first pad conditioning disk, and wherein said second drive shaft is operable to move said first break-in head toward said platen, thereby pressing said first pad conditioning disk against said polishing pad mounted on said first surface of said platen.

2. The off-line tool as set forth in claim 1 wherein said mechanical drive assembly is capable of holding a third drive shaft in a position proximate said first surface of said platen.

3. The off-line tool as set forth in claim 2 further comprising a second break-in head capable of being removably attached to said third drive shaft, wherein said second break-in head is adapted to receive a second pad conditioning disk, and wherein said third drive shaft is operable to move said second break-in head toward said platen, thereby pressing said second pad conditioning disk against said polishing pad.

4. The off-line tool as set forth in claim 3 wherein said mechanical drive assembly is capable of rotating said second and third drive shafts.

5. The off-line tool as set forth in claim 4 wherein said first break-in head is adapted to receive a first plurality of pad conditioning disks.

6. The off-line tool as set forth in claim 4 wherein said second break-in head is adapted to receive a second plurality of pad conditioning disks.

7. The off-line tool as set forth in claim 4 wherein said mechanical drive assembly couples said first drive shaft to said second and third drive shafts such that rotation of said first drive shaft causes rotation of said second and third drive shafts.

8. The off-line tool as set forth in claim 7 wherein said first break-in head comprises a first drive mechanism capable of rotating said first pad conditioning disk.

9. The off-line tool as set forth in claim 8 wherein said first drive mechanism is coupled to said second drive shaft and rotates said first pad conditioning disk by translating a rotating motion of said second drive shaft into a rotating motion of said first pad conditioning disk.

10. The off-line tool as set forth in claim 9 wherein said first drive mechanism comprises a first gear assembly coupled to said second drive shaft and to a first spindle connected to said first pad conditioning disk.

11. The off-line tool as set forth in claim 10 wherein said second break-in head comprises a second drive mechanism capable of rotating said second pad conditioning disk.

12. The off-line tool as set forth in claim 11 wherein said second drive mechanism is coupled to said third drive shaft and rotates said second pad conditioning disk by translating a rotating motion of said third drive shaft into a rotating motion of said second pad conditioning disk.

13. The off-line tool as set forth in claim 12 wherein said second drive mechanism comprises a second gear assembly coupled to said third drive shaft and to a second spindle connected to said second pad conditioning disk.

14. The off-line tool as set forth in claim 4 wherein said first break-in head is adapted to receive a first plurality of pad conditioning disks and to press said first plurality of pad conditioning disks against said polishing pad.

15. The off-line tool as set forth in claim 14 wherein said first break-in head comprises a first drive mechanism capable of rotating said first plurality of pad conditioning disks.

16. The off-line tool as set forth in claim 15 wherein said first drive mechanism is coupled to said second drive shaft and rotates said first plurality of pad conditioning disks by translating a rotating motion of said second drive shaft into rotating motions of said first plurality of pad conditioning disks.

17. The off-line tool as set forth in claim 16 wherein said first drive mechanism comprises a first gear assembly coupled to said first drive shaft and to each of a first plurality of spindles connected to said first plurality of pad conditioning disks.

18. The off-line tool as set forth in claim 17 wherein said second break-in head is adapted to receive a second plurality of pad conditioning disks and to press said second plurality of pad conditioning disks against said polishing pad.

19. The off-line tool as set forth in claim 18 wherein said second break-in head comprises a second drive mechanism capable of rotating said second plurality of pad conditioning disks.

20. The off-line tool as set forth in claim 19 wherein said second drive mechanism is coupled to said third drive shaft and rotates said second plurality of pad conditioning disks by translating a rotating motion of said third drive shaft into rotating motions of said second plurality of pad conditioning disks.

21. The off-line tool as set forth in claim 20 wherein said second drive mechanism comprises a second gear assembly coupled to said second drive shaft and to each of a second plurality of spindles connected to said second plurality of pad conditioning disks.

22. A method of breaking in a pad conditioning disk for a chemical mechanical polishing (CMP) system using an off-line tool comprising: i) a platen having a first surface for mounting a polishing pad thereon; ii) a motor for rotating the polishing pad, wherein the motor is coupled to the platen via a first drive shaft associated with a mechanical drive assembly; and iii) said mechanical drive assembly capable of holding a second drive shaft in a position proximate the first surface of the platen, the method comprising the steps of:

removably attaching a break-in head to the second drive shaft;

mounting the pad conditioning disk on the break-in head;

moving the second drive shaft such that the break-in head is moved toward the platen, thereby pressing the pad conditioning disk against the polishing pad mounted on the first surface of the platen.

23. A pad conditioning disk broken in by the method as set forth in claim 22.

* * * * *

UNITED STATES PATENT AND TRADEMARK OFFICE

CERTIFICATE OF CORRECTION

PATENT NO. : 7,094,134 B2
APPLICATION NO. : 10/873558
DATED : August 22, 2006
INVENTOR(S) : Randall J. Lujan It is certified that error appears in the above-identified patent and that said Letters Patent is hereby corrected as shown below:

On the cover page,

[*] Notice: Subject to any disclaimer, the term of this patent is extended or adjusted under 35 USC 154(b) by (135) days Delete the phrase "by 135 days" and insert -- by 255 days--

Signed and Sealed this

Seventh Day of August, 2007

JON W. DUDAS
*Director of the United States Patent and Trademark Office*